US007182054B2

(12) United States Patent
Albat et al.

(10) Patent No.: US 7,182,054 B2
(45) Date of Patent: Feb. 27, 2007

(54) VALVE DRIVE INCLUDING A ROCKER LEVER WITH HYDRAULICALLY ACTUATED DRIVER

(75) Inventors: Rainer Albat, Fellbach (DE); Uwe Meyer, Stuttgart (DE)

(73) Assignee: Daimler Chrysler AG, Stuttgart (DE)

( * ) Notice: Subject to any disclaimer, the term of this patent is extended or adjusted under 35 U.S.C. 154(b) by 0 days.

(21) Appl. No.: 11/188,303

(22) Filed: Jul. 25, 2005

(65) Prior Publication Data

US 2005/0252466 A1 Nov. 17, 2005

Related U.S. Application Data

(63) Continuation-in-part of application No. PCT/EP2003/013687, filed on Dec. 4, 2003.

(30) Foreign Application Priority Data

Jan. 30, 2003 (DE) ..... 103 03 567

(51) Int. Cl.
*F01L 1/18* (2006.01)

(52) U.S. Cl. ..... 123/90.39; 123/90.16; 123/90.4; 123/90.41

(58) Field of Classification Search ..... 123/90.39, 123/90.16, 90.41, 90.4
See application file for complete search history.

(56) References Cited

U.S. PATENT DOCUMENTS 5,651,336 A * 7/1997 Rygiel et al. ..... 123/90.16
5,904,226 A * 5/1999 Sakaguchi et al. ..... 184/67
6,257,201 B1 7/2001 Kajiura et al.

FOREIGN PATENT DOCUMENTS

| | | |
|---|---|---|
| DE | 1 526 485 | 3/1970 |
| DE | 36 13 912 | 10/1986 |
| DE | 40 25 569 | 7/1991 |
| DE | 196 42 059 | 4/1997 |
| DE | 197 29 198 | 1/1999 |
| DE | 199 61 795 | 6/2000 |
| JP | 02 252 911 | 10/1990 |
| JP | 03271511 | 12/1991 |
| JP | 06 002518 | 1/1994 |
| JP | 06 033713 | 2/1994 |
| JP | 20 01132423 | 5/2001 |

* cited by examiner

*Primary Examiner*—Thomas Denion
*Assistant Examiner*—Zelalem Eshete
(74) *Attorney, Agent, or Firm*—Klaus J. Bach

(57) ABSTRACT

In a valve drive for a piston internal combustion engine with a first rocker lever which is in operative contact with at least a first cylinder valve, wherein a cam structure including a first cam and at least one additional cam is in active contact with a second rocker lever, which can be placed in force transmission contact with the first rocker lever by an actuator element for transferring the pivot motion generated by the first and second cams selectively from the second rocker lever to the first rocker lever and at a rate depending on an idling angle determined by the actuator element.

9 Claims, 2 Drawing Sheets

VALVE DRIVE INCLUDING A ROCKER LEVER WITH HYDRAULICALLY ACTUATED DRIVER

This is a Continuation-in-Part Application of International Application PCT/EP2003/013687 filed 4 Dec. 2003 and claiming the priority of German Application 103 03 567.2 filed 30 Jan. 2003.

BACKGROUND OF THE INVENTION

The invention relates to a valve drive for piston internal combustion engines having at least one control cam, one additional cam, a first rocker lever and a second rocker lever which are pivotably mounted on a rocker lever support shaft, wherein the first rocker lever is in active contact with at least a first cylinder valve, at least the additional cam is in active contact with the second rocker lever, and the second rocker lever can be placed in force flux with the first rocker lever by means of an actuator element.

A brake device having a cam-actuated outlet valve is disclosed in DE 15 26 485. In this document, in addition to a customary rocker lever cam arrangement, an auxiliary rotational cam device is provided with a hydraulically actuated locking piston which, by actuating the locking piston arranged within the rocker lever, ensures the force flux between an auxiliary cam and the rocker lever.

In the document: Impressum, HONDA Deutschland GmbH, Öffentlichkeitsarbeit [publicity work], a rocker lever cam arrangement with a first control cam and a second control cam are shown on page 12. The control cams each have an operative connection to a cylinder valve by means of a lever which is pivotably mounted on a rocker lever shaft. A further rocker lever which can be connected in a positively locking fashion to the rocker levers by means of a driving actuator element is assigned to an additional control cam. The actuator element is moved axially with respect to the rocker lever axis here.

It is the object of the present invention to provide a valve drive in such a way that a flexible actuation of an engine valve is facilitated.

SUMMARY OF THE INVENTION

In a valve drive for a piston internal combustion engine with a first rocker lever which is in operative contact with at least a first cylinder valve, wherein a cam structure including a first cam and at least one additional cam is in active contact with a second rocker lever, which can be placed in force transmission contact with the first rocker lever by an actuator element for transferring the pivot motion generated by the first and second cams selectively from the second rocker lever to the first rocker lever and at a rate depending on an idling angle determined by the actuator element.

Active contact means that in addition to a possible film of lubricant and/or a play-compensating element there is direct contact between the respective parts of the transmission. Furthermore, a brake system which is based on the valve drive according to the invention can also be implemented with relatively new engine designs. A constant throttle is no longer necessary. In addition to the simple embodiment, the installation space is utilized to an optimum degree. The valve drive according to the invention can also be used with lower and upper cam shafts.

In this respect it is advantageous that the actuator element has a locking direction which corresponds to the direction of an actuating force effective between the first rocker lever and the second rocker lever and the locking direction is in a plane perpendicularly to a central axis of the rocker lever support shaft and at a distance from the central axis. Owing to the distance between the rocking direction or the locking force and the central axis of the rocker lever support shaft, a lever can be provided which can be configured to an optimum degree in accordance with the control forces to be applied. The adjustment paths of the actuator element are proportional to the distance from the central axis and can thus also be changed with the distance from the central axis.

According to one embodiment, an idling angle $\alpha$ which can be adjusted by the actuator element with respect to a pivoting movement on the rocker lever support shaft can be provided between the first rocker lever and the second rocker lever. The control path of the cylinder paths which is generated by the control cams or auxiliary cams can be adjusted or changed owing to the adjustability of the idling angle $\alpha$. With idling angle of $\alpha=0°$, the first rocker lever follows the second rocker lever; an increase in the idling angle $\alpha$ results in a delayed actuating movement of the first rocker lever and a limitation of the entire actuating movement of the first rocker lever.

It is advantageous if the actuator element is a movable piston and is connected to a control line with a control valve for a pressure medium. The embodiment of the actuator element as a hydraulically actuated piston ensures simple and wear-free operation.

It is also advantageous if the control line includes a non-return valve with a bypass line. The use of a non-return valve ensures, on the one hand, the pressure build up within the control line when the control valve is closed. On the other hand, when there is a loss of pressure medium, within the control line, pressure medium can be supplied via the bypass line.

Finally, in a preferred embodiment of the invention, the piston is arranged movably within a cylinder, which is connected to the control line, and abuts indirectly or directly a first face area of the first rocker lever. When the control valve is closed, relative movement between the piston and the pressure medium cylinder is prevented so that the actuating movement of the second rocker lever is transmitted at least partially to the first rocker lever. When the control valve is opened, the pressure medium volume of the pressure medium cylinder is reduced, and until the control valve closes, the second rocker lever carries out idling motion during which the first rocker lever remains in its rest position.

For the present invention, it is of particular importance that a restoring element which counteracts the force of the pressure medium is provided for the piston in the cylinder. As a result of the restoring element, the restoring movement of the piston is initiated immediately after the control valve opens. As a result, dynamic pressure shocks on the first rocker lever are avoided.

In conjunction with the embodiment and arrangement according to the invention the first rocker lever is pivotably mounted on the rocker lever support shaft or on the second rocker lever. A bypass line which is not illustrated and via which pressure medium is sucked in is assigned to the non-return valve. It is also advantageous if the first rocker lever, the actuator element and the second rocker lever form a physical unit.

It is also advantageous if the control cam is selectively in active contact with the first rocker lever, and the additional cam is in active contact only with the second rocker lever. With a direct actuation of the first rocker lever, only the braking operating mode would be implemented via the second rocker lever and the control element. In addition to the additional cams, a further control cam could also be used if required by activation of the actuator element. In this way, it is possible to implement an engine economy operating mode or an engine high-power operating mode which requires the customary shape of the control cam as well as a changed shape of the control cam.

The invention will be explained in greater detail in the following description thereof on the basis of the accompanying drawings.

DESCRIPTION OF A PARTICULAR EMBODIMENT

Figure 1:
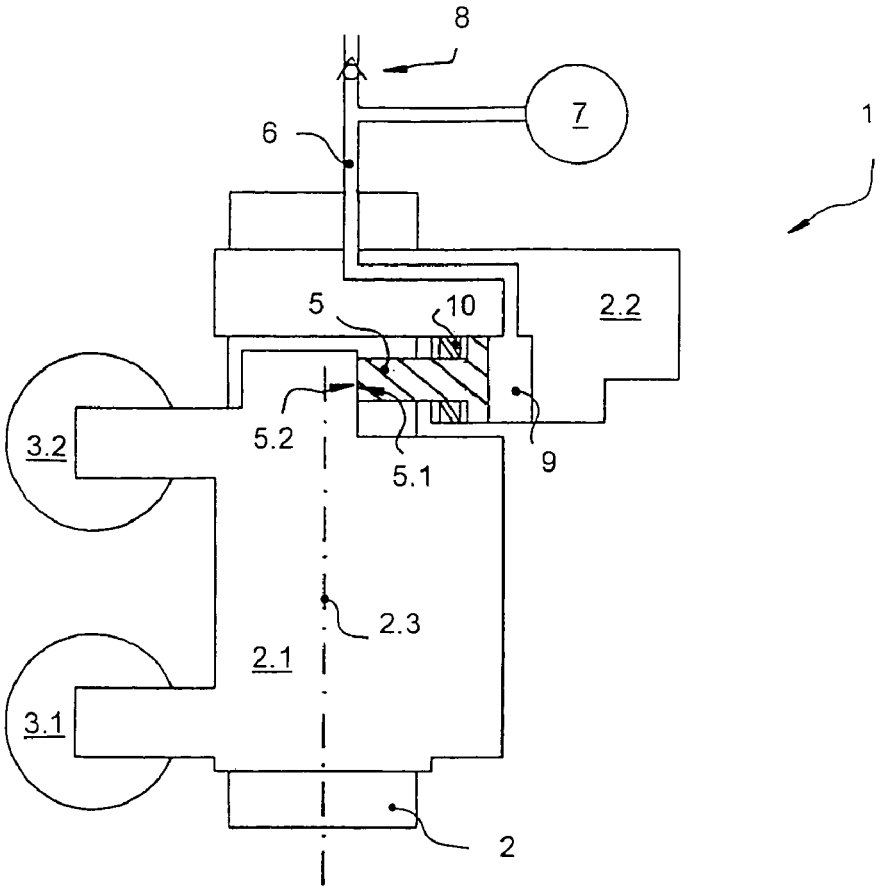
FIG. 1 is a schematic illustration of the valve drive with a first rocker lever, second rocker lever and actuator element.

The valve drive 1 according to FIG. 1, comprises essentially a first rocker lever 2.1 and a second rocker lever 2.2 which are pivotably supported on a rocker lever support shaft 2. A first cylinder valve 3.1 and a second cylinder valve 3.2 which are actuated when there is a pivoting movement of the first rocker lever 2.1 about the rocker lever shaft 2 or its central axis 2.3 are assigned to the first rocker lever 2.1.

The first rocker lever 2.1 and the second rocker lever 2.2 are arranged adjacent to each other with respect to the central axis 2.3 of the rocker lever support shaft 2 and can be coupled mechanically by means of an actuator element 5 which is embodied as a piston. The piston 5 is displaceably arranged within a pressure medium cylinder 9 of the second rocker lever 2.2. The pressure medium cylinder 9 is connected via a control line 6 to a control valve 7 and a non-return valve 8. The actuator piston 5 bears with its end face 5.1 opposite the pressure medium cylinder 9 against a stop 5.2 of the second rocker lever 2.2, or can be placed against it.

Figure 2:
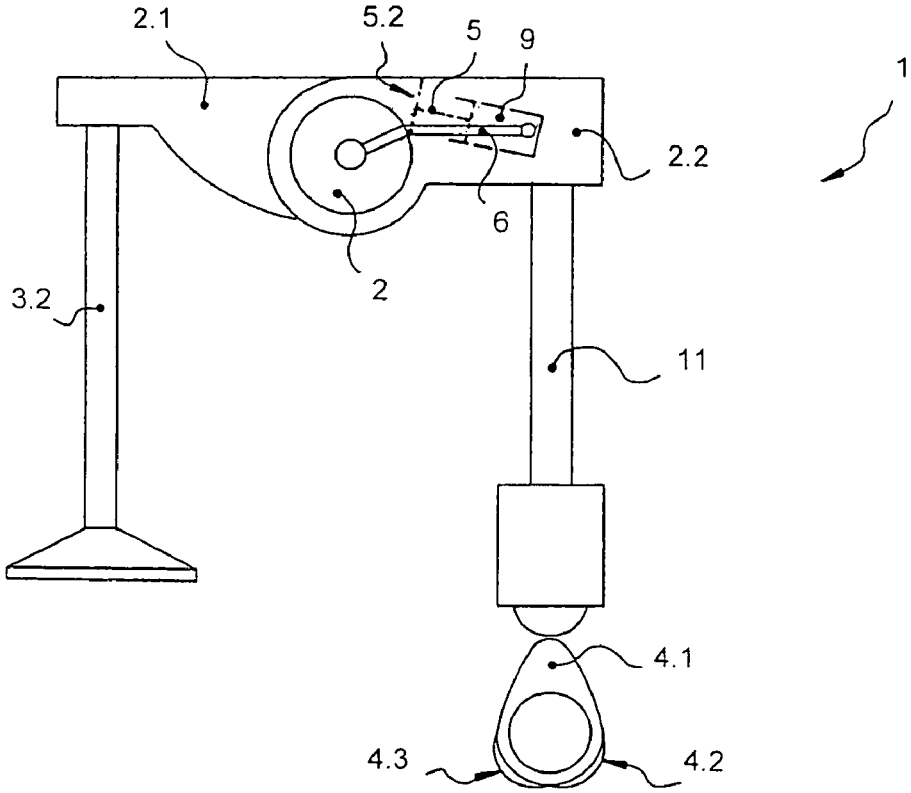
FIG. 2 is a schematic illustration of the valve drive in a side view with a first rocker lever, a second rocker lever a control cam and an auxiliary cam.

As apparent from FIG. 1, when the control valve 7 is closed, actuation of the second rocker lever 2.2 in the upward direction by a tappet 11 according to FIG. 2 would cause the first rocker lever 2.1 to be actuated so as to undergo a corresponding pivoting movement. The pressure medium disposed in the pressure medium cylinder 9 can not be released either via the nonreturn valve 8 nor via the closed control valve 7 so that the holding position of the actuating piston 5 according to FIG. 1 is ensured. A restoring element 10 is arranged between the actuating piston 5 and the second rocker lever 2.2. The restoring element 10 which is embodied as the spring element ensures a restoring movement of the actuating piston within the pressure medium cylinder 9 when the control valve 7 is opened. When the control valve 7 is closed, the pivoting movement of the second rocker lever 2.2 which is generated by the tappet 11 or a control cam 4.1 and two additional cams 4.2, 4.3 or auxiliary cams according to FIG. 2 is transmitted via the actuating piston 5 to the first rocker lever 2.1 and thus to the first cylinder valve 3.1 and the second cylinder valve 3.2. Depending on the actuation of the control valve 7, only a part of the pivoting movement of the second rocker lever 2.2 is transmitted to the first rocker lever 2.1. For example, after the pivoting movement generated by the control cam 4.1 is completed, the control valve 7 could be opened so that the pivoting movement generated by the auxiliary cam 4.2 and/or the auxiliary cam 4.3 is carried out only by the second rocker lever 2.2 and the first rocker lever 2.1 remains unaffected.

The control cam 4.1 and the auxiliary cams 4.2, 4.3 according to FIG. 2 are arranged on a single cam path, i.e. together they form one cam. The reciprocating movement generated by the cam or the tappet 11 is transmitted via the second rocker lever 2.2 and the actuating piston 5 to the first rocker lever 2.1 and thus to the cylinder valves 3.2 and 3.1. The actuating piston 5 which is arranged inside the pressure medium cylinder 9 bears against the stop face 5.2 of the first rocker lever 2.1 and carries the first rocker lever 2.1 along when the control valve 7 is closed.

The control line 6 is shown arranged at least partially within the rocker lever support shaft 2 and extends to the control valve 7 or the nonreturn valve 8.

Figure 3:
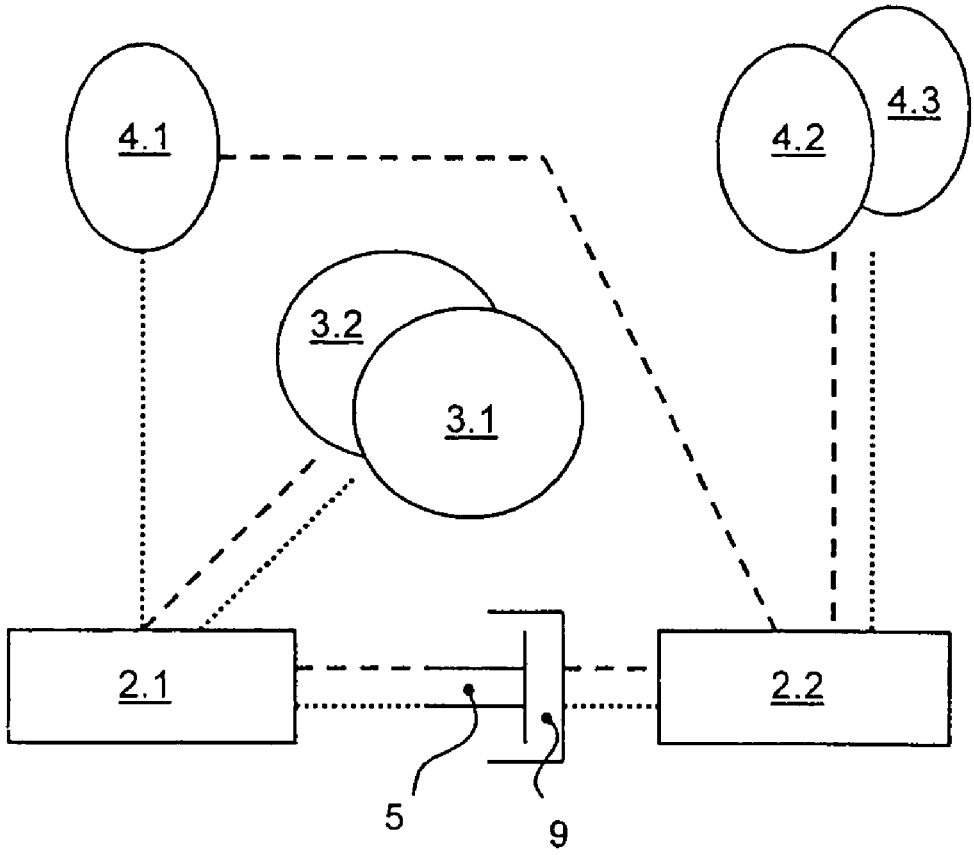
FIG. 3 is a basic outline of the force flux between a first rocker lever, a second rocker lever, control cam, an auxiliary cam and a cylinder valve.

The basic diagram of the force flux between the individual drive elements which is illustrated in FIG. 3 shows the control cam 4.1, the auxiliary cams 4.2, 4.3, the first rocker lever 2.1, the second rocker lever 2.2, the actuator piston 5 and the cylinder valves 3.1, 3.2. The connecting lines which are illustrated between the individual drive elements constitute here the positively locking connections which can be established. The control cam 4.1 and the auxiliary cams 4.2, 4.3 are in direct active contact with the second rocker lever 2.2 via the push rod 11. The second rocker lever 2.2 is in active contact with the pressure medium cylinder 9, and the pressure medium cylinder 9 is in active contact with the first rocker lever 2.1 via the actuator piston 5. In turn, the first rocker lever 2.1 is in direct active contact or has a direct force flux with the cylinder valves 3.1, 3.2.

In an exemplary embodiment which is illustrated by dashed lines and is not explained further, the control cam 4.1 is in direct active contact with the first rocker lever 2.1, and the latter is in direct active contact with the cylinder valves 3.1, 3.2. Only the auxiliary cams 4.2, 4.3 are in active contact with the cylinder valves 3.1, 3.2 via the second rocker lever 2.2, the pressure medium cylinder 9, the control piston 5 and the first rocker lever 2.1.

What is claimed is:

1. A valve drive (1) including a rocker lever arrangement for a piston internal combustion engine including a control cam (4.1) with an additional cam (4.2), a first rocker lever (2.1) and a second rocker lever (2.2), which are pivotably supported on a rocker lever support shaft (2), the first rocker lever (2.1) being in operative contact with at least a first cylinder valve (3.1) and the second rocker lever (2.2) including an actuator element (5) for operative engagement with the first rocker lever (2.1), the control cam (4.1) being in operative contact with the second rocker lever (2.2) for transferring pivot motion from the second rocker lever (2.2) controllably to the first rocker lever (2.1) and at least the additional cam (4.2) being in operative contact with the second rocker lever (2.2) depending on the actuation of the actuator element (5), said actuator element (5) having a locking direction which corresponds to the direction of a locking force acting between the first rocker lever (2.1) and the second rocker lever (2.2), and the locking direction extending in a plane perpendicular to a central axis (2.3) of the rocker lever support shaft (2) and at a distance from the central axis (2.3).

2. The device as claimed in claim 1, wherein an idle angle $\alpha$ which can be adjusted by the actuator element (5) with respect to a pivoting movement on the rocker lever support shaft (2) is provided between the first rocker lever (2.1) and the second rocker lever (2.2).

3. The device as claimed in claim 1, wherein the actuator element (5) is a movable piston and is disposed in a cylinder (9) connected to a control line (6) and to a control valve (7) for controlling the admission and release of a pressure fluid to the cylinder (9).

4. The device as claimed in claim 3, wherein the control line (6) includes a nonreturn valve (8).

5. The device as claimed in claim 3, wherein the actuator element is a piston (5), which is arranged so as to be movable within a pressure medium cylinder (9) which is connected to the control line (6), and said piston (5) is engageable indirectly or directly with a first end face (5.1) against the first rocker lever (2.1).

6. The device as claimed in claim 3, wherein a restoring element (10) which counteracts the compressive force in the pressure fluid is disposed within the pressure medium cylinder (9) so as to act against the piston (5).

7. The device as claimed in claim 3, wherein the first rocker lever (2.1) is pivotably supported on one of the rocker lever support shaft (2) and the second rocker lever (2.2).

8. The device as claimed in claim 1, wherein the first rocker lever (2.1), the actuator element (5) and the second rocker lever (2.2) form an assembly unit.

9. The device as claimed in claim 1, wherein selectively the control cam (4.1) is in operative contact with the first rocker lever (2.1), and the additional cam (4.2) is in operative contact only with the second rocker lever (2.1).

* * * * *